US005205675A

United States Patent [19]

Hamel

[11] Patent Number: 5,205,675

[45] Date of Patent: Apr. 27, 1993

[54] PRECAST CRIBBING WALL SYSTEM

[76] Inventor: Arthur L. Hamel, 7880 Red Jacket Way, Jessup, Md. 20794

[21] Appl. No.: 847,271

[22] Filed: Mar. 10, 1992

[51] Int. Cl.[5] ..... E02D 5/00

[52] U.S. Cl. ..... 405/273; 52/286; 405/272; 405/284

[58] Field of Search ..... 405/273, 272, 284, 285, 405/286; 52/286, 594, 608, 607, 603

[56] References Cited

U.S. PATENT DOCUMENTS

| | | | |
|---|---|---|---|
| 811,534 | 2/1906 | Akers et al. | 52/286 |
| 1,398,695 | 11/1921 | Hull | 405/273 X |
| 1,514,081 | 11/1924 | Hahn | 405/273 X |
| 1,704,941 | 3/1929 | Hobson et al. | 405/273 |
| 4,312,606 | 1/1982 | Sarikelle | 405/286 |
| 4,815,897 | 3/1989 | Risi et al. | 405/284 |
| 4,920,712 | 5/1990 | Dean, Jr. | 405/286 |
| 4,936,712 | 6/1990 | Glickman | 405/284 |
| 4,993,206 | 2/1991 | Pardo | 405/286 |
| 5,030,035 | 7/1991 | Babcock | 405/262 |

FOREIGN PATENT DOCUMENTS 2921489 12/1979 Fed. Rep. of Germany .

2-128016 5/1990 Japan .

*Primary Examiner*—Dennis L. Taylor

*Attorney, Agent, or Firm*—Richard C. Litman

[57] ABSTRACT

A system for the construction of cribbing and retaining walls includes a series of precast reinforced concrete blocks, the blocks each having a longitudinal ridge along the bottom surface and longitudinal and lateral channels on the upper surface. A number of courses of the blocks may be built up with the longitudinal channels of an underlying course mating with the ridges of the next overlying course to interlock for greater strength. Additionally, positive horizontally and vertically interlocking corners may be formed by mating the underlying lateral channel of one block with the overlying longitudinal ridge. The blocks may be formed using only two molds having two different lengths with all other dimensions the same, so that one longer length block plus the width of another block are equal to the combined length of two shorter blocks. In this way, the various blocks may be overlapped to interlock and form a variety of various structures for retaining and cribbing walls.

8 Claims, 2 Drawing Sheets

PRECAST CRIBBING WALL SYSTEM

FIELD OF THE INVENTION

This invention relates generally to precast concrete construction units, and more specifically to a precast and reinforced concrete block system for the construction of cribbing and retaining walls and the like which provides corner reinforcement without the need for additional specially cast members.

BACKGROUND OF THE INVENTION

Retaining walls are commonly used in landscaping and construction projects where some differential level of the adjacent soil is required. It is well known that relatively high differential pressures are thereby created on the opposite sides of such walls, requiring relatively great strength in order to support such loads. In addition, certain industries require specialized structures which must provide much the same characteristics as those generally required for retaining walls. An example is the rairroad industry, in which closed or semi-closed cribs are constructed in order to elevate components such as electrical transformers and the like. These cribs are generally filled with a relatively coarse aggregate, similar to the material used in the construction of the bedding used for support of the rails and ties.

Essentially two types of construction have been developed for such walls: The formation of a cast concrete wall on the construction site, or the construction of the wall from precast components. The casting of such a wall on the site requires retaining forms for the concrete to be constructed and some time for the poured concrete to cure, as well as the addition of reinforcing bars ("rebars") to the concrete before it is cured. This is a relatively labor and time intensive process. Alternatively, such walls are commonly constructed from precast units which may be rapidly assembled to form the required wall.

While precast systems for retaining walls have been developed which comprise a relatively few differently shaped components, these systems do not readily lend themselves to use in the construction of cribbing walls due to the corners involved in such construction. In order to achieve the required strength at the corners of such crib walls, it has heretofore been necessary to form additional more complex shapes which require additional casting forms and thereby raise the overall cost of walls constructed of such a relatively large variety of differently shaped units.

The need arises for a precast construction system utilizing a relatively small number of different shapes and sizes of precast concrete forms. The system must provide the asymmetrical strength required of such retaining or crib walls, while at the same time providing a secure and interlocking corner construction in order to achieve essentially the same strength as the remainder of the wall.

DESCRIPTION OF THE RELATED ART

U.S. Pat. No. 4,312,606 issued to S. Sarikelle on Jan. 26, 1982 discloses an Interlocking Prefabricated Retaining Wall System. The system includes lugs offset from the prefabricated blocks into which reinforcing anchors may be inserted, as well as specially formed tie members which extend inward from the remainder of the wall.

No means is disclosed for the formation of corners using the components disclosed.

U.S. Pat. No. 4,815,897 issued to A. Risi et al. on Mar. 28, 1989 discloses a Retaining Wall System comprising parallel courses of precast ribbed blocks and cooperating ribbed ties extending therebetween. The patent discloses a right angle corner construction using the system, but no means is disclosed for the positive vertical interlocking of the individual blocks at the corners; rather, a plug is inserted within the end of the cooperating recess of each block at a corner.

U.S. Pat. No. 4,920,712 issued to R. W. Dean, Jr. on May 1, 1990 discloses a Concrete Retaining Wall Block, Retaining Wall And Method Of Construction Therefore (sic). Walls constructed according to the method of this patent include special clips used to secure the individual blocks together, and while the blocks provide for the construction of curved walls by means of some modification, they do not provide for the construction of vertically interlocking corners as in the present invention.

U.S. Pat. No. 4,936,712 issued to M. N. Glickman on Jun. 26, 1990 discloses a Retaining Wall System utilizing specially formed upwardly convex shaped blocks containing a plurality of longitudinal ridges. The shape and ridges enable the blocks to be stacked in overlying courses other than directly vertically atop one another. No means of using the blocks of this patent to form corners is disclosed.

U.S. Pat. No. 4,993,206 issued to J. Pardo on Feb. 19, 1991 discloses Interlocking Building Units And Walls Constructed Thereby. Several different specialized and relatively complex block shapes are disclosed, thus increasing the cost of forming such blocks considerably. Yet another specialized shape is required for the formation of corners, unlike the present invention.

U.S. Pat. No. 5,030,035 issued to J. W. Babcock on Jul. 9, 1991 discloses an Earth Retaining System formed of a plurality of relatively complex preformed blocks. No means of forming a corner with the blocks of this patent is disclosed.

German Patent No. 2,921,489 issued to SF-Vollverbundstein on Dec. 20, 1979 discloses a Retaining Wall of Profiled Concrete Blocks. The blocks are stackable and vertically interlocking to a certain extent, and include ties formed in a different shape than the primary blocks. No corner interlock means is disclosed.

Finally, Japanese Patent No. 2-128016 issued to S. Hamanaka on May 16, 1990 discloses a Stone Masonry Retaining Wall. The construction disclosed is similar to that of the patent to Glickman discussed, but further includes a polymer grid for additional strength. No corner construction means is disclosed.

None of the above noted patents, either singly or in combination, are seen to disclose the specific arrangement of concepts disclosed by the present invention.

SUMMARY OF THE INVENTION

By the present invention, an improved retaining and cribbing wall system is disclosed.

Accordingly, one of the objects of the present invention is to provide an improved wall system comprising precast concrete block units.

Another of the objects of the present invention is to provide an improved wall system adaptable to use in a retaining wall or a cribbing wall.

Yet another of the objects of the present invention is to provide an improved wall system comprising a relatively few different precast shapes, differing primarily in length.

Still another of the objects of the present invention is to provide an improved wall system which includes the capability of forming right angled corners using the same basic precast form.

A further object of the present invention is to provide an improved wall system which further provides means for the positive vertical interlocking of corner elements.

An additional object of the present invention is to provide an improved wall system which also provides vertical interlocking of linear wall sections.

With these and other objects in view which will more readily appear as the nature of the invention is better understood, the invention consists in the novel combination and arrangement of parts hereinafter more fully described, illustrated and claimed with reference being made to the attached drawings.

BRIEF DESCRIPTION OF THE DRAWINGS

Similar reference characters designate corresponding parts throughout the several figures of the drawings.

DESCRIPTION OF THE PREFERRED EMBODIMENT

Figure 2:
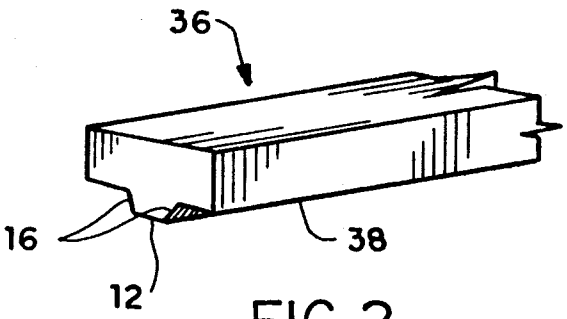
FIG. 2 is a broken perspective view of a coping unit of the present invention.
Figure 1:
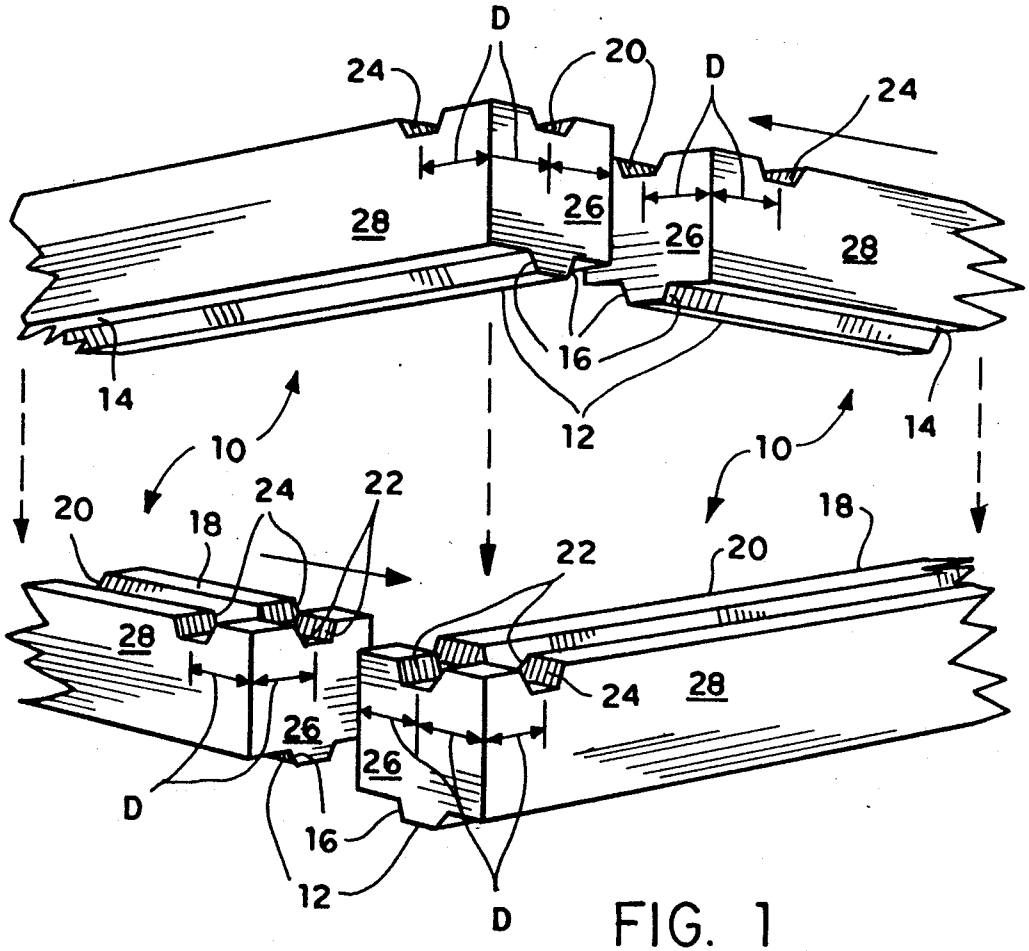
FIG. 1 is an exploded perspective view of two courses of the precast units of the present invention, showing the interlocking means.
Figure 4:
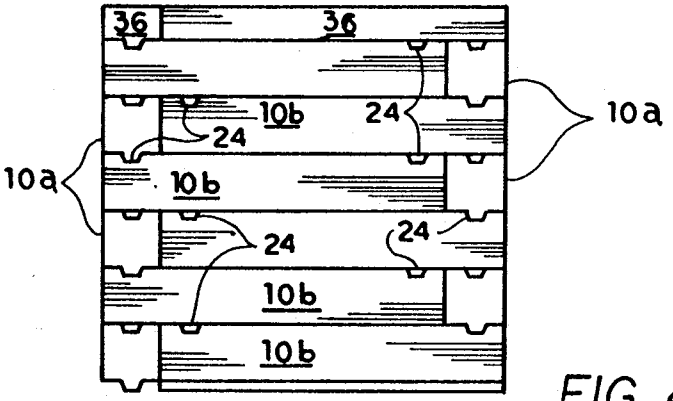
FIG. 4 is an elevation view of one side of the structure of FIG. 3.

Referring now to the drawings, particularly FIG. 1 of the drawings, the present invention will be seen to relate to a system for the construction of retaining and cribbing walls incorporating a plurality of precast units or blocks, which blocks provide means for positive vertical interlocking of overlying courses along both straight sections and at corners. While many retaining walls are constructed along essentially straight courses, the requirements for cribbing walls are somewhat different in that generally a rectangular structure, either with or without openings, is required. The present invention provides for the integrity of such cribbing structures.

The blocks 10 used to form structures according to the present invention are preferably formed of precast concrete, reinforced with reinforcement bars ("rebars") as desired or required. Blocks formed according to the present invention are of a generally rectangular solid form and have been made having a width and height of eight by eight inches, but obviously the present invention may be applied to such blocks formed in any practical dimensions. An examination of FIG. 1 shows that each of the blocks 10 has a longitudinal ridge 12 extending from the center of the lower surface 14. These ridges 12 are in the form of a shallow V, having sloping sides 16 which provide a wider base and relatively narrower apex for ridges 12. This specific shape enables ridges 12 to better cooperate with any upper surface 18 of underlying blocks 10.

Each of the upper surfaces 18 of blocks 10 will be seen to provide a longitudinal channel 20, which channels 20 include sloping sides 22 providing a narrower base and wider upper dimension and thus serving to closely mate with the ridges 12 of any overlying blocks 10. Thus, a construction using blocking 10 will be seen to be relatively rigid, due to the interlocking feature of longitudinal lower ridges 12 and cooperating upper channels 20 of vertically stacked courses of blocks 10.

The features described above enable blocks 10 to be assembled in plural underlying and overlying courses in a straight line, as in the case of the typical retaining wall. However, a closed or semi-closed structure, as shown in the plan view of FIG. 3, requires corners. In order to provide a vertically interlocking corner construction for blocks 10, and additional lateral channel 24 is provided in the upper surface 18 near each end 26 of each block 10. Lateral channels 24 are formed having the same width and depth as longitudinal channels 20 in order to cooperate closely with bottom ridges 12, and are spaced inwardly from the ends 26 a distance D equal to the distance D which longitudinal channels 20 and ridges 12 are spaced from the lateral surfaces 28 of blocks 10. This specific arrangement of lateral channels 24 relative to the ends 26 of blocks 10, provides that any corner construction using the present invention will have each end 26 of blocks 10 essentially flush with the parallel lateral surfaces 28 of the underlying and overlying courses of blocks 10 in order to form a regular corner without any irregularities due to extended ends 26 of blocks 10

In accordance with the drawings accompanying this specification, it will be seen that lateral channels 24 form right angles to longitudinal channels 20. This specific angle serves to insure that corners of structures constructed by means of the present invention will form right angles, as is generally desired in the construction of such structures. However, it will be readily understood that by providing lateral channels 24 having some angle other than 90 degrees to longitudinal channels 20, walls having corners with a like angle may be constructed if so desired.

In order to more firmly secure each overlying course of blocks 10 upon the underlying courses, vertical reinforcement passages 30 are provided at the intersection 32 of each longitudinal channel 20 and lateral channel 24. Reinforcement passages 30 are provided for the insertion of reinforcement bars or the like, in order to more solidly tie together the plurality of courses of blocks 10 in a given construction, and will be seen to extend vertically completely through each block 10 at the locations described above. Additional reinforcement passages may be provided at other locations along the length of blocks 10 as desired, for further strength at such locations as joints between adjacent blocks 10, etc. Additional lifting passages 34 may be formed at various points as desired, as at the center of gravity of shorter sections or near each end of longer sections.

Unlike other construction units for similar structures, the blocks 10 of the present invention will be seen to be substantially similar in all dimensions excepting that of length. Even so, it will be seen that for most structures, only two different lengths of blocks 10 need be provided, thus simplifying, the cost of form or mold construction for the blocks 10 of the present invention, the stocking of the required number of different blocks 10, and the construction at the site. An examination of FIG. 3 will show that only two different lengths of blocks 10 are incorporated: Blocks **10*a* each having a length L1, and blocks 10*b* each having a length L2. The blocks 10*a* and 10*b* produced in accordance with the present invention have lengths respectively of 96 and 52 inches; obviously, blocks 10***a* and 10*b* may be formed having lengths L1 and L2 of any practicable lengths desired or required. The critical factor in determining the lengths L1 and L2 respectively of blocks 10*a* and 10*b*, is that two blocks 10*b* must be equal in total length to one block 10*a* plus the width W of a block 10*a* or 10*b*. In other words, the following formula applies: $2\times L2=L1+W$. Accordingly, the lengths noted above for the blocks 10*a* and 10*b* formed in accordance with the present invention will be seen to provide a total length of $L1+W=96+8=104$ inches for a block 10*a* and width of a second block 10, and $2\times L2$ of $2\times 52=104$ inches for two blocks 10*b*.

Figure 3:
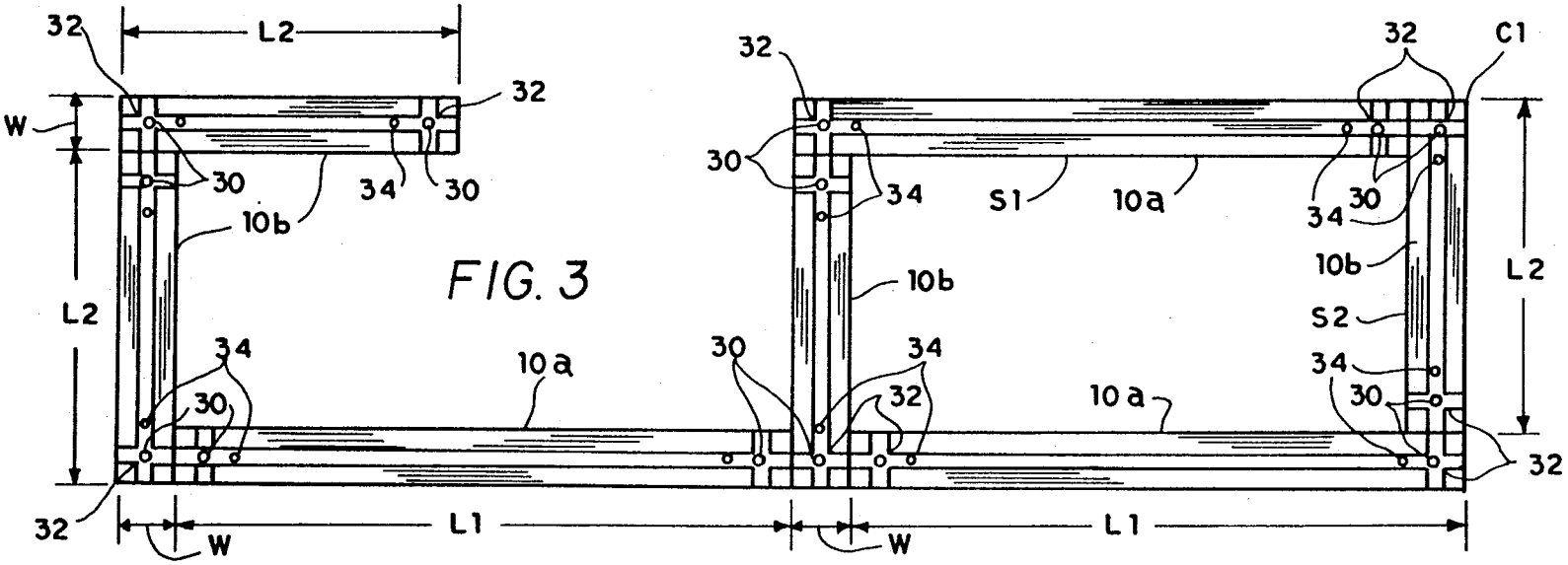
FIG. 3 is a plan view of a typical structure which may be formed using the precast units of the present invention.

The above dimensions for the lengths of the blocks 10*a* and 10*b* enable such blocks 10*a* and 10*b* to be stacked vertically in underlying and overlying courses to form a variety of structures, such as the structure of the plan view of FIG. 3. It will be seen that, for example, by using two blocks 10*b* overlying the block 10*a* of side S1, one block 10*b* will extend to corner C1 and thus overlay the underlying end of the block 10*b* of side S2. This overlap of blocks 10 at the corners of structures provides for positive vertical and horizontal interlock of the various blocks 10 of the present invention. While not every joint may be interlocked with every other joint at every other course, it will be seen that even in a relatively complex structure as shown in FIG. 3 that no more than three vertically overlying courses will be needed to insure that all walls are interlocked, even where a wall joins another wall at a midpoint. A minimum of special lengths or cutting of standard lengths will be required using the lengths L1 and L2 of the present invention, even in the case of a relatively complex structure as shown in FIG. 3. Simpler structures may make use of the two lengths L1 and L2 described above without need for modification. In any case, a longitudinal channel 20 will cooperate with the corresponding overlying longitudinal ridge 12 when a straight section of wall is formed, while a lateral channel 24 will mate with the corresponding overlying longitudinal ridge 12 when a corner is formed. No lateral bottom ridge is required, nor is such a lateral ridge desired, as such a lateral ridge would interfere with the upper surface 18 of the underlying blocks 10*a* or 10*b* in many instances.

A structure making use of the blocks 10*a* and 10*b* of the present invention may be constructed using standard procedures, i.e., providing a base of compacted earth or aggregate material. In cases where the base is sufficiently compacted, it will be necessary to form a trench or depression in order to provide clearance for the bottom ridge 12. At this point, blocks 10*a* and 10*b* may be placed in position with further overlying courses installed as described above, each overlying course having the bottom ridges mating with the corresponding upper channels of the underlying course. Generally, no mortar or similar material is used between blocks 10*a* and/or 10*b*, as such mortar would preclude drainage from between blocks 10*a* and 10*b*. However, the blocks 10*a* and 10*b* of the present invention lend themselves to assembly with mortar if desired, in the manner of conventional masonry construction.

Positive horizontal and vertical interlocking of any corners is provided by the mating of lateral channels 24 and cooperating longitudinal ridges 12, according to the relative placement of blocks 10*a* and 10*b*. When the desired number of courses has been reached, coping blocks 36 may be placed upon the top course. Coping blocks 36 will be seen to have a longitudinal ridge 12 along the bottom surface 38, identical in form and function to the ridge 12 provided for blocks 10*a* and 10*b*. However, coping blocks 36 are provided with a flat upper surface 40, in order to provide a better watershed by means of the elimination of the channels 20 and 24 of blocks 10*a* and 10*b*. The completed structure thus formed may then be filled with an aggregate or other material as desired, in the case of a crib structure, or finished as required for the use desired.

It is to be understood that the present invention is not limited to the sole embodiment described above, but encompasses any and all embodiments within the scope of the following claims.

I claim:

1. A system for the construction of retaining and cribbing walls and similar structures containing linear walls and corners and formed of a plurality of preformed blocks, said preformed blocks are of generally rectangular solid form and defined by upper and lower surfaces defining a height, two oppositely spaced apart lateral surfaces defining a width, and two opposite end surfaces defining a length, wherein;

each of said preformed block includes a longitudinal ridge extending downward from said lower surface, a longitudinal upper channel within said upper surface, and at least two lateral channels extending across said upper surface between said lateral surfaces and forming an intersection with said longitudinal channels, coping blocks having lower surfaces including cooperating longitudinal ridges and level upper surfaces, said ridges of said coping blocks each have sides inwardly sloped to provide a decreasing width for each of said ridges, and said longitudinal and lateral channels of said preformed blocks each have outwardly sloping sides to provide an increasing width for each said longitudinal and lateral channels of said preformed blocks, whereby a first course of said preformed blocks is laid and a second course of said preformed blocks is laid overlying said first course with said longitudinal ridges of said preformed blocks forming said second course mating with said longitudinal channels of said preformed blocks forming said first course to form at least one said linear wall and at least one said longitudinal ridge of at least one said preformed block forming said second course mating with at least one said lateral channel of at least one said preformed block forming said first course to form at least one said corner, thus continuing to form a plurality of said courses defining said wall having at least one said corner, and a plurality of said coping blocks is installed upon an upper part of a last course of said wall.

2. The system of claim 1 wherein;

each said intersection formed by said longitudinal channels and said lateral channels of said blocks has an angle of ninety degrees.

3. The system of claim 1 wherein;

each said blocks includes a reinforcement passage at each said longitudinal and lateral channel intersection.

4. The system of claim 1 wherein;

each said blocks includes at least one lifting passage.

5. The system of claim 1 wherein;

each said blocks is formed of reinforced concrete.

6. A system for the construction of retaining and cribbing walls and similar structures containing linear walls and corners and formed of a first and second set of preformed blocks, said preformed blocks are of generally rectangular solid form and defined by upper and lower surfaces defining a height, two oppositely spaced apart lateral surfaces defining a width, and two opposite end surfaces defining a first length of said first set and a second length of said second set, each of said preformed blocks includes a reinforcement passage and a channel being located on an upper surface of said preformed blocks, wherein the distance comprising one said length of one said preformed block of said first set added to said width of one said preformed blocks is equal to the distance comprising two said second lengths of said preformed blocks of said second set; and coping blocks having lower surfaces including cooperating longitudinal ridges and level upper surfaces, said ridges of said coping blocks each have sides inwardly sloped to provide a decreasing width for each of said ridges, and said channel of said preformed blocks has an outwardly sloping sides to provide an increasing width for said channel of said preformed blocks.

7. The system of claim 6 wherein;

each said blocks includes at least one lifting passage.

8. The system of claim 6 wherein;

each said blocks is formed of reinforced concrete.

* * * * *